United States Patent [19]

Kriegsman

[11] Patent Number: 4,841,878

[45] Date of Patent: Jun. 27, 1989

[54] FURNITURE WITH APPEARANCE CHANGEABLE TOP

[76] Inventor: Elliot Kriegsman, 314 Chatterton Pkwy., Hartsdale, N.Y. 10530

[21] Appl. No.: 87,996

[22] Filed: Aug. 17, 1987

Related U.S. Application Data

[63] Continuation of Ser. No. 580,344, Feb. 15, 1984, abandoned.

[51] Int. Cl.[4] ..... A47B 13/08

[52] U.S. Cl. ..... 108/90; 108/62; 108/157

[58] Field of Search ..... 108/90, 62, 63, 153, 108/157, 159, 161; 40/611, 490, 491, 100

[56] References Cited

U.S. PATENT DOCUMENTS

| | | | |
|---|---|---|---|
| 256,780 | 4/1882 | Wilson | 40/611 |
| 1,379,134 | 5/1921 | Steddom | 40/490 |
| 1,738,429 | 12/1929 | Heyman . | |
| 1,940,320 | 12/1933 | Oxenrecter | 108/62 |
| 2,833,609 | 5/1958 | Lawless . | |
| 3,212,952 | 10/1965 | Turner | 108/161 |
| 3,227,105 | 1/1966 | Reisdorff et al. | 108/62 |
| 3,583,337 | 6/1971 | Yokeley | 108/90 |
| 3,676,279 | 7/1972 | Beaver . | |
| 4,310,091 | 1/1982 | Hara et al. | 40/490 |
| 4,327,512 | 5/1982 | Oliver | 40/10 D |

FOREIGN PATENT DOCUMENTS

| | | | |
|---|---|---|---|
| 1801171 | 4/1970 | Fed. Rep. of Germany | 108/161 |
| 747568 | 6/1933 | France | 108/161 |
| 2247054 | 5/1975 | France | 108/90 |
| 2294666 | 7/1976 | France | 108/159 |
| 8341 | 4/1911 | United Kingdom | 108/157 |
| 621258 | 4/1949 | United Kingdom | 108/90 |

*Primary Examiner*—Peter A. Aschenbrenner
*Attorney, Agent, or Firm*—Stephen E. Feldman

[57] ABSTRACT

A cover, of see-through glass or plastic is provided of a size and configuration to fit over the top of a table top, and with sides extending down and adjacent the sides of the table top. An insert, one of a plurality of inserts, having opposed surfaces each of a different color, finish, decoration or design, is formed of a size and configuration to be disposed between the cover and the table top and so as to expose one of its surfaces. The cover is readily removable and replaceable and thus the insert, and/or its exposed surface, can be easily changed to provide any one of a plurality of aesthetic appearances for the table top.

An alternative embodiment forms the table top as an open picture frame with a plurality of braces spanning the opening and connected to adjacent or opposite sides of the frame and formed to support within the frame opening a backing upon which an insert (also with its opposite sides of different colors, finish, decoration, or design) and a cover are supported. As in the first embodiment the cover may be unattached and readily removable to facilitate exposure of a different side of the insert or of a different insert. The insert may also be changed by disconnecting the braces and dropping the backing and insert out.

Another alternative embodiment provides a space between a see-through top and a backing; and an opening in the side of the table permitting insertion and removal of an insert into said space through said opening.

2 Claims, 2 Drawing Sheets

FURNITURE WITH APPEARANCE CHANGEABLE TOP

This application is a continuation of application Ser. No. 580,344, filed Feb. 15, 1984 abandoned.

BACKGROUND OF THE INVENTION-FIELD OF APPLICATION

This invention relates to furniture; and more particularly to the top, or work surface, of furniture items such as desks, credenzas, tables and the like.

BACKGROUND OF THE INVENTION-DESCRIPTION OF THE PRIOR ART

Items of furniture, such as desks, credenzas, tables, or the like are available in a multitude of sizes, shapes, and finishes. Tables, in particular, are available in many varieties such as breakfast tables, dining room tables, coffee tables, end tables, and parsons tables. While such desks, credenzas, and tables may be available in many sizes, shapes, and heights they all possess, amongst other common features, a top or upper work surface.

In many instances the furniture top (work surface) is fabricated from the same material (wood, metal, plastic, etc.) as the rest of the item of furniture and finished in the same manner as the other components of the item of furniture. In other instances, although the top is fabricated from the same material as the rest of the furniture it is finished in a different color, pattern, or other configuration. Still other available furniture pieces utilize different materials for the furniture top than for the rest of the furniture item.

The variety of constructions, finishes, and materials, thus available serve to satisfy the desire for differences in aesthetic appearance. However, once such an item of furniture is obtained its appearance is generally unchangeable unless the furniture item is refinished or replaced. Refinishing furniture is a task requiring some degree of skill; especially if the furniture item is to have an aesthetically pleasing appearance when refinished. In addition, furniture refinishing can be time consuming, tedious and expensive even when done by a do-it-yourselfer; with the cost increasing when done professionally.

Replacing furniture just because one is unhappy with its aesthetic appearance can also be an expensive proposition.

The expense and inconvenience of furniture refinishing and replacement is sometimes required due to the age or physical condition of the item of furniture. However, quite often the furniture item is in good if not excellent physical condition, and of acceptable aesthetics; but, the time has come for a new appearance. It would thus seem foolish to replace, or refinish, a good piece of furniture, merely because there is a desire for a new aesthetic appearance.

There are available furniture items such as tables wherein the table top or work surface is changeable without resorting to refinishing the table top. However,, furniture items such as those shown in U.S. Pat. No. 1,850,420 granted on Mar. 22, 1932 to S. J. Schuldt for "Game Table"; in U.S. Pat. No. 3,001,843 granted on Sept. 26, 1961 to S. D. Davis for "Convertible Table"; and in U.S. Pat. No. 3,227,105 granted on Jan. 4, 1966 to R. Reisdorff et al for "Table" are all relatively complex in construction and result in a changed table top or work surface at a level other than the normal table level. Such a change in the level of the table surface can in fact be inconvenient and/or unacceptable if table surfaces of uniform height are desired or required.

Alternatively, an item of furniture such as shown in U.S. Pat. No. 3,212,952 granted on Oct. 19, 1965 to J. turner for "Decorative Table" provides an aesthetically pleasing table top; but one which must remain as set up by the manufacturer. While an item of furniture such as shown in U.S. Pat. No. 2,833,609 granted on May 6, 1958 to C. J. Lawless for "Table Construction With Reversible Top" is not only relatively complex in construction but only provides either one of two table top configurations.

SUMMARY OF THE INVENTION

It is therefore an object of this invention to provide a new and improved item of furniture.

It is another object of this invention to provide a new and improved top or work surface for an item of furniture.

It is still another object of this invention to provide a new and improved readily changeable top or work surface for an item of furniture.

It is yet another object of this invention to provide a new and improved table or the like.

It is yet still another object of this invention to provide a new and improved top, or work surface, of changeable appearance for a table or the like.

It is a further object of this invention to provide a new and improved, readily changeable in appearance, top, or work surface, for a table or the like.

This invention involves items of furniture, such as desks, credenzas, tables, and the like, having a top or work surface; and contemplates forming the item of furniture so that the appearance of the top, or work surface, can be readily and easily changed.

Other features and advantages of the invention in its details of construction and arrangement of parts will be seen from the above, from the following description of the preferred embodiment when considered with the drawing, and from the appended claims. In addition, these and other objects and advantages of the present invention will become evident from the description which follows.

DESCRIPTION OF THE PREFERRED EMBODIMENT

For convenience, the invention will be described as applied to an item of furniture in the form of a dining room table having four legs located respectively at each corner of a rectangular table top. It should be understood, nevertheless that the item of furniture could be any form of table (such as a coffee table, end table, parsons table etc.) or for that matter, a desk, credenza, or the like; as long as the item of furniture has a top, or work surface. Furthermore, the configuration of the top or work surface, need not be rectangular and it can be supported by any appropriate number of legs or arrangement of support structure, suitably located to support the table top.

Figure 1:
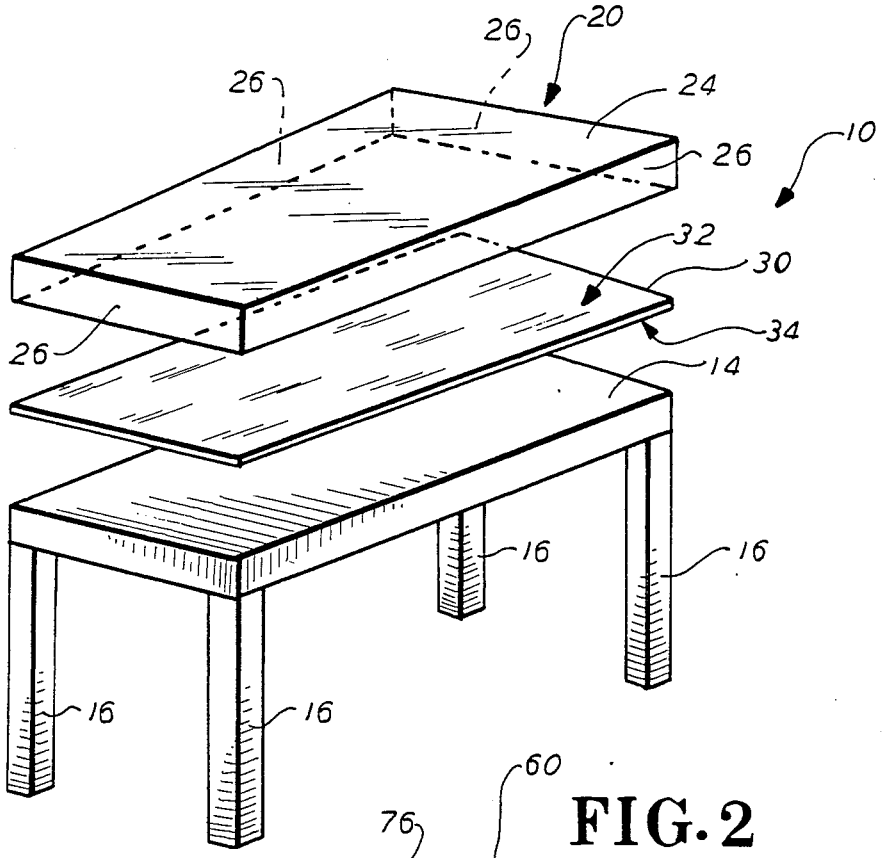
FIG. 1 exploded perspective of an item of furniture, in the form of a table, incorporating the instant invention.

With reference to FIG. 1 there is generally shown at 10 an item of furniture in the form of a dining room type table having a table top 14 supported at each of its corners by a leg 16. Table 10 is of a size and height suitable for use as a dining room table, however, table 10 can be sized for other uses such as a coffee table, end table, parsons table or the like. Table 10 is formed from wood, with top 14 of rectangular configuration supported at each corner by a wooden leg 16. Table 10 can be formed of metal, plastic or other suitable material; and with its top and legs of other suitable configurations and of either the same or different materials. A suitable finish such as stain, varnish, paint, laminate or the like can be applied to table 10.

A plastic cover 20 is formed of a size and configuration to be readily placed over top 14 of table 10. Cover 20 includes an upper or top surface 24 and depending sides 26; and is formed of a clear plastic or other suitable but clear material.

An insert 30 is formed of a size and configuration to fit on top of table top 14 beneath cover 20, when cover 20 is in place on table 10. Insert 30 is provided with an upper surface 32 and a lower surface 34 each finished with a different pattern color, design or the like.

Thus, by placing insert 30 on top of table 10 with surface 34 of insert 30 facing down and surface 32 of insert 30 facing up, and by placing cover 20 over insert 30 and onto table top 10, a first appearance is provided for the top of table 10. Alternatively, that appearance (for table 10) can be changed readily and relatively easily by lifting off cover 20 and turning insert 30 over so that its surface 32 is down and its surface 34 is up. Similarly, table top 10 can have its appearance changed by lifting off cover 20 and replacing insert 30 by a completely different insert of different colors, finishes, design or decoration. After the new insert is so positioned cover 20 is replaced.

Figure 2:
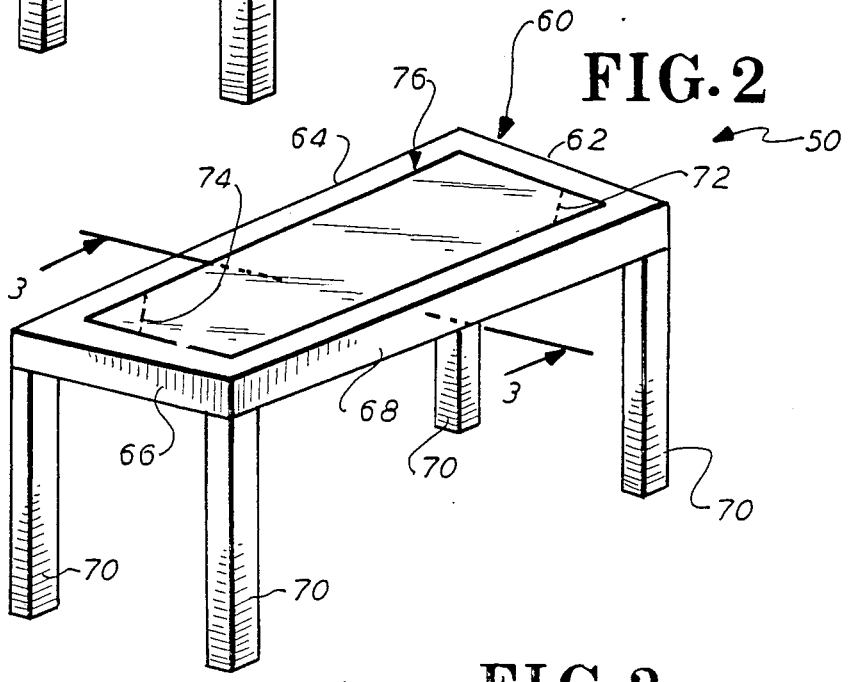
FIG. 2 is a perspective showing of an alternative embodiment of the invention, incorporated into an item of furniture in the form of a table.
Figure 3:
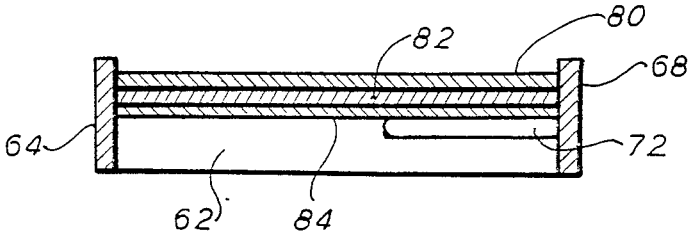
FIG. 3 is a sectional view taken on line 3—3 of FIG. 2.

In the embodiments of FIGS. 2 and 3 there is shown another item of furniture 50 also in the form of a table. As for the previous embodiment this item of furniture can be any one of numerous types of tables or for that matter a desk, credenza or the like. The materials, configuration and finish applied to table 50 can be any ones of the many suitable for furniture.

Table 50 includes a top 60 in the form of a frame having sides 62, 64, 66 and 68 respectively; with legs 70 similar to legs 16 of FIG. 1; disposed at the corners of top 60 to support same. A pair of diagonally disposed rods 72, 74 extend respectively between sides 62, 68 and 64, 66. Rods 72, 74 are disposed beneath an upper surface 76 of top 60 a distance sufficient to accommodate a cover 80, insert 82, and backing 84 within the frame-like configuration formed by table top 60. Rods 72, 74 support cover 80, insert 82 and backing 84 so that the upper surface of cover 80 is either disposed level with upper surface 76 of top 60, or so that the upper surface of cover 80 is disposed below the level of upper surface 76.

Additional support rods, similar to rods 72, 74, may be utilized if desired. Cover 80 may be formed of suitable clear plastic or glass; while backing 84 may be formed of plastic, glass or other material which can be either clear, opaque, translucent or otherwise.

Insert 82, like insert 32 of FIG. 1, may be finished in different colors, patterns, or designs on each surface thereof; and is positionable between cover 80 and backing 84 with either surface up. Changing the appearance of the table top or work surface is readily and easily accomplished by lifting cover 80 out from table top 60 and either turning insert 82 over or changing same. Cover 80 is thereafter replaced.

Alternatively, table 50 may be constructed so that support rods 72, 74 are removable from below table cover 80 and backing 84. Backing 84 and insert 82 would then be dropped out from below and insert 82 turned over or changed as desired. Insert 82, backing 84 and support rods 72, 74 would thereafter be replaced. Cover 80 would be appropriately supported by top 60 so as to remain in position when insert 82 is so changed; or if desired, cover 80 may also drop down.

Figure 4:
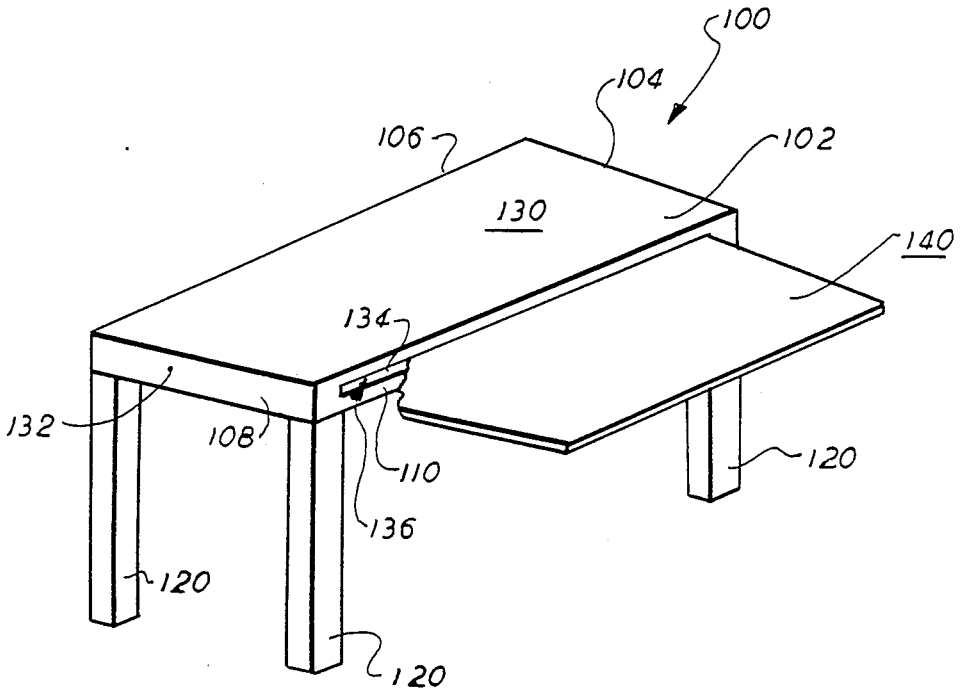
FIG. 4 is a perspective showing of another alternative embodiment of the invention.

In the embodiments of FIG. 4 there is shown another item of furniture 100 also in the form of a table. As for the previous embodiment this item of furniture can be any one of numerous types of tables or for that matter a desk, credenza or the like. The materials, configuration and finish applied to table 100 can be any ones of the many suitable for furniture.

Table 100 includes a top 102 having sides 104, 106, 108 and 110 respectively; with legs 120 similar to legs 16 of FIG. 1; disposed at the corners of top 102 to support same. Top 102 includes a clear see-through, upper portion 130 supported by a table base 132 so that there is a space 134 disposed therebetween. Space 134 is closed at sides 104, 106 and 108 of table 102 but opens at 136 to side 110 of table 102, obviously opening 134 can just as easily open to any of sides 104, 106, or 108.

An insert panel 140 is formed to a size and configuration to be inserted through opening 136 into space 134 to occupy all or part of space 134.

Insert 140, like insert 32 of FIG. 1, may be finished in different colors, patterns, or designs on each surface thereof; and is positionable between top 102 and table base 134 with either surface. Changing the appearance of the table top or work surface is readily and easily accomplished by sliding insert 140 out through opening 136 and either turning insert 140 over or changing same.

From the above description, it will thus be seen that there has been provided a novel and improved article of furniture, and top or work surface, for an article of furniture, such as a table, desk, credenza or the like; which top or work surface, has a readily changeable appearance.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

I claim:

1. An item of furniture comprising:

(a) a tabletop substantially rectangular in configuration and having a plane surface, said surface having thickness defined by an undersurface and forming a base for said furniture;

(b) a plurality of legs coupled to and extending from said undersurface of said table top said legs positioned at the corners of said table top for supporting said table top from the floor;

(c) cover means having a plane surface and depending sides extending from said plane surface, said cover means of a size and configuration proximating and fitting over said table top said depending sides of a length for substantially covering said thickness of said table top, said cover means being formed from clear material;

(d) insert means having first and second surfaces and being of a size and configuration for covering said plane surface of said table top and having a thickness so that said insert means fits between said cover means and said plane surface of said table top when said cover means is positioned on said table top and (e) said cover means being unattached and readily removable from said table top by lifting said cover means there from for permitting reversing said insert means for changing the surface of said insert means exposed through said clear material of said cover means, for changing the appearance of the surface of said table top.

2. An article of furniture comprising:

(a) a top defined by a substantially flat surface having a predetermined configuration and being of predetermined size;

(b) support means connected to said top for supporting said top;

(c) a cover defined by a substantially flat surface and depending sides, said flat surface having substantially the same predetermined configuration as said top and being substantially the same said predetermined size as said top but capable of being placed over said top with said depending sides extending downwardly from the perimeter of said flat surface of said cover and from the perimeter of said flat surface of said top, said cover being clear for providing a see-through cover; and (d) insert means having an upper surface and a lower surface each having a different appearance, said insert means having said predetermined configuration and being of said predetermined size for inserting on to the flat surface of said top and under said cover for providing a first appearance of said flat surface of said top when said upper surface is exposed through said cover and providing a second appearance of said flat surface of said top when said lower surface is exposed through said cover.

* * * * *